US006224245B1

(12) United States Patent
Boebel

(10) Patent No.: US 6,224,245 B1
(45) Date of Patent: May 1, 2001

(54) VEHICLE HEADLIGHT

(75) Inventor: Doris Boebel, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/297,456

(22) PCT Filed: Jul. 2, 1998

(86) PCT No.: PCT/DE98/01820

§ 371 Date: May 1, 1999

§ 102(e) Date: May 1, 1999

(87) PCT Pub. No.: WO99/19664

PCT Pub. Date: Apr. 22, 1999

(30) Foreign Application Priority Data

Oct. 15, 1997 (DE) ..... 197 45 467

(51) Int. Cl.[7] ..... F21V 1/00
(52) U.S. Cl. ..... 362/509; 362/343
(58) Field of Search ..... 362/509, 516, 362/518, 539, 305, 346, 343

(56) References Cited

U.S. PATENT DOCUMENTS 1,756,084 * 4/1930 Caughlan .
4,959,757 * 9/1990 Nakata ..... 362/520
5,003,435 * 3/1991 Nakata ..... 362/520

* cited by examiner

*Primary Examiner*—Stephen Husar
(74) *Attorney, Agent, or Firm*—Michael J. Striker

(57) ABSTRACT

The headlight has a light source (12), a reflector (10), and a baffle (32) with a light admission opening (34), the baffle being disposed downstream of the reflector (10) in the light exit direction (30). The reflector (10) has a central reflector region (16), by which an at least approximately parallel fractional beam (20) is reflected, and at least one peripheral reflector region (24), by which a fractional beam (28) that converges in horizontal longitudinal planes (22) and is at least approximately parallel in vertical longitudinal planes (18) is reflected. The fractional beams (20, 28) are concentrated at least substantially on the light admission opening (34) of the baffle (32), whose cross section is smaller than the cross section of the reflector (10) at the front edge (36) of the reflector. The beam emerging from the headlight has pronounced horizontal scattering, despite the small cross section of the light admission opening (34) of the baffle (32).

4 Claims, 1 Drawing Sheet

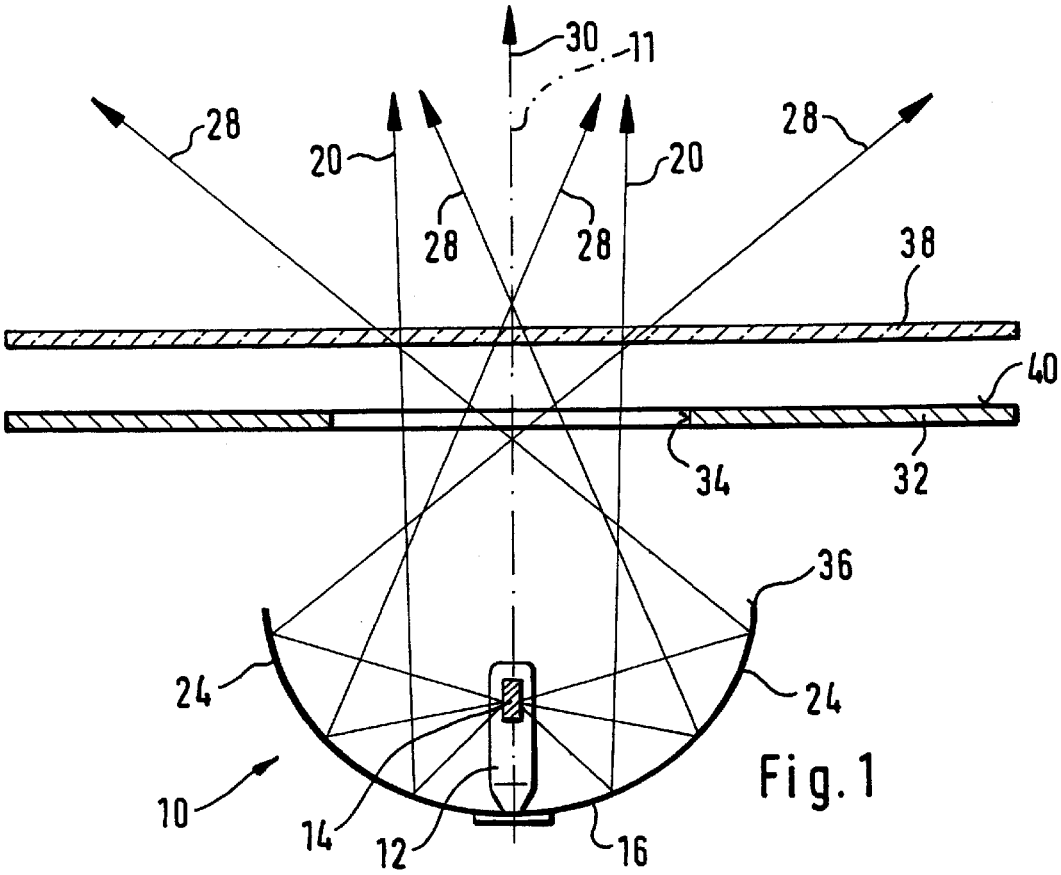
Fig. 1
Fig. 2
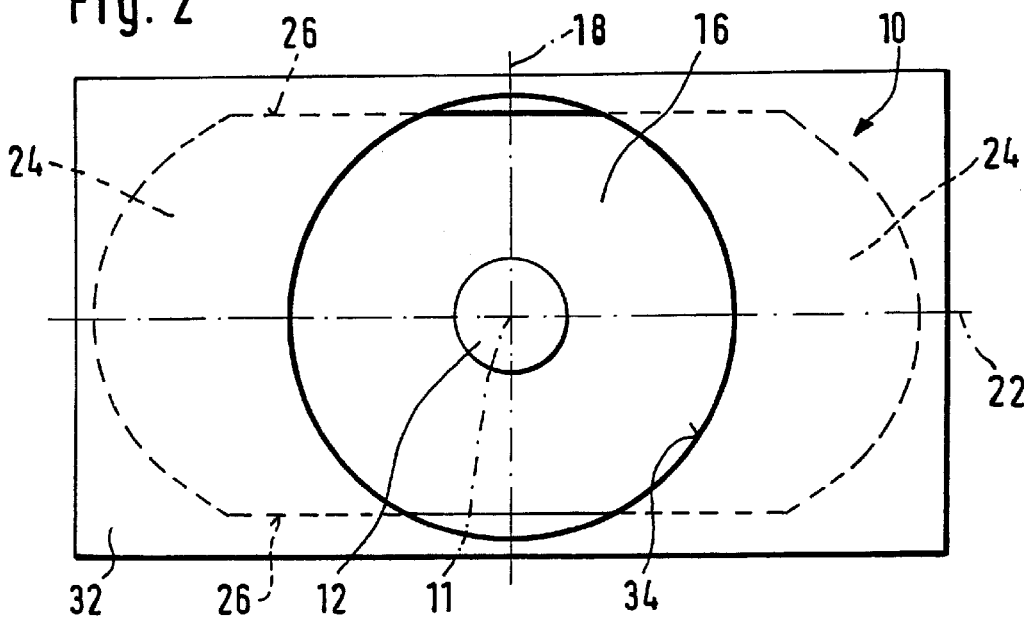

VEHICLE HEADLIGHT

BACKGROUND OF THE INVENTION

The invention is based on a headlight for vehicles

One such headlight is known from German Patent Disclosure DE 31 39 943 A1. This headlight has a light source and a reflector, and the reflector has a sector which is embodied such that by it, light emitted from the light source is reflected as a beam that converges in horizontal planes and is at least approximately parallel in vertical planes.

To achieve an adequate light yield, the reflector must be embodied with a sufficient size, and at its front edge pointing in the light exit direction, it has a relatively large cross section. However, for the sake of the best possible aerodynamics and for design reasons, vehicle manufacturers also demand headlights with the smallest possible light exit openings. To meet this demand, headlights designed on the projection principle are typically provided, in which a converging is reflected by the reflector, passes along a baffle that generates a light/dark boundary, and passes through a lens. These headlights, however, entail increased production cost, because of the lens and the baffle.

SUMMARY OF THE INVENTION

It is therefore an object of the present invention to provide headlight for vehicles, which avoids the disadvantages of the prior art.

In keeping with these objects, an opaque baffle is disposed in the light exit direction downstream of the reflector and has a light admission opening with a cross-section smaller than the cross-section of the reflector on the front edge pointing in the light admission opening, the beam reflected by the reflector is concentrated at least substantially on the light admission opening of the baffle, and the light admission opening of the baffle is formed as at least approximately circular or oval in cross-section.

The headlight according to the invention has the advantage over the prior art that it has a simple design and can be made with a small light exit opening, yet an adequate light yield can still be attained, since light is reflected by the reflector in such a way that it can pass through the light admission opening of the baffle.

In the dependent claims, advantageous features and refinements of the headlight of the invention are disclosed.

BRIEF DESCRIPTION OF THE DRAWING

One exemplary embodiment of the invention is shown in the drawing and described in detail below.

FIG. 1 shows a headlight in a horizontal longitudinal section, and

FIG. 2 shows the headlight in a front view.

DESCRIPTION OF THE PREFERRED EMBODIMENT

A headlight for vehicles, in particular motor vehicles, shown in FIGS. 1 and 2 is used for instance as a fog light, by which in its operation a beam of light with pronounced horizontal scattering and a continuous, at least approximately horizontal upper light/dark boundary is emitted. The headlight has a reflector 10 of concave curvature, into which a light source 12 is inserted in its apex region. The light source 12 can be an incandescent bulb, gas discharge lamp, or other suitable bulb. The luminous body 14 of the light source 12, that is, its spiral-wound filament or electric arc, is disposed, in the installed position of the light source 12 in the reflector 10, preferably at least approximately along the optical axis 11 of the reflector 10. The reflector 10 may be of sheet metal and made by deep drawing, or it may be of plastic and made by injection molding. In its apex region 16, or a central region, the reflector 10 is embodied in its shape such that through this central region 16, light emitted by the light source 12 is reflected as a fractional beam 20 that in vertical longitudinal planes 18 is at least approximately parallel or at least only slightly scattered. The fractional beam 20 has an upper light/dark boundary that extends at least approximately horizontally. In horizontal longitudinal planes 22, the fractional beam 20 again extends at least approximately parallel or has only slight scattering. If the fractional beam 20 has slight scattering, then it may extend slightly convergently or slightly divergently. The central reflector region 16 may for instance be embodied such that in a vertical longitudinal section containing the optical axis 11, a parabola or at least a parabola-like curve through it results, so that light emitted by the light source is reflected at least approximately parallel to the optical axis 11 or is inclined downward relative to it. In the case of a horizontal longitudinal section, containing the optical axis 11, through the central reflector region 16 as well, a parabola or at least a parabola-like curve can result, so that light emitted by the light source 12 is reflected at least approximately parallel to the optical axis 11. If the fractional beam 20 has horizontal scattering, then the reflector region 16 can be embodied such that in the horizontal longitudinal section through it, which section contains the optical axis 11, an ellipse, an ellipse-like curve, a hyperbola, a hyperbola-like curve, or some arbitrary other curve results as an alternative.

The central reflector region 16 is adjoined by peripheral reflector regions 24. The reflector 10 may for instance, as shown in FIG. 2, have a greater length horizontally than vertically and can be bounded at the top and bottom by approximately horizontal, flat walls 26. In that case, the central reflector region 16 extends substantially over the full height of the reflector 10 and is adjoined on each side by a peripheral reflector region 24. The peripheral reflector regions 24 extend for instance over the full height of the reflector 10 or only over a portion of its height. The peripheral reflector regions 24 are embodied in their shape such that light emitted by the light source 12 is reflected by them as fractional beams 28 that converge in horizontal longitudinal planes 22 and are at least approximately parallel in vertical longitudinal planes 18. The beams 28 reflected by the peripheral reflector regions 24 also have an at least approximately horizontally extending upper light/dark boundary, which has at least approximately the same position as the light/dark boundary of the fractional beam 20 reflected by the central reflector region 16. The peripheral reflector regions 24 may for instance be embodied such that in a vertical longitudinal section through them that contains the px 11, a parabola or at least a parabola-like curve results, so that light emitted by the light source 12 is reflected at least approximately parallel to the optical axis 11 or inclined downward relative to it. In the case of a horizontal longitudinal section through the peripheral reflector regions 24 that includes the optical axis 11, an ellipse or at least ellipse-like curves can result, so that light emitted by the light source 12 is reflected convergently to the optical axis 11. The peripheral reflector regions 24 can also be embodied in their shape such that by them, as the distance from the optical axis 11 increases, light emitted by the light source is reflected increasingly convergently, so that the rays of the fractional beams 28 intersect the optical axis 11 at a lesser distance from the reflector 10. The transition between the central reflector region 15 and the peripheral reflector regions 24 is preferably continuous, without any shoulder or kink.

In the light exit direction 30 downstream of the reflector 10, an opaque baffle 32 is provided, which has a light admission opening 34. As shown in FIG. 2, the majority of the reflector 10 is covered by the baffle 32. The light admission opening 34 of the baffle 32 has a cross section which is smaller than the cross section of the reflector 10, at the front edge 36 of the reflector pointing in the light exit direction 30. The light admission opening 34 of the baffle 32 may for instance, as shown in FIG. 2, be at least approximately circular or can also be oval with a greater width than height. Arbitrary other cross-sectional forms are also possible for the light admission opening 34 of the baffle 32, however. The light source 12 can also be assigned a direct-light baffle, not shown, by which light emitted by the light source 12 directly in the light exit direction 30 and not striking the reflector 10 is screened off.

The baffle 32 is disposed in such a way that the largest possible portion of the fractional beams 20 and 28 reflected by the reflector pass through the light admission opening 34 of the baffle and can exit the headlight. The rays of the fractional beams 28 reflected by the peripheral reflector regions 24 preferably intersect the optical axis 11 in the region of the plane in which the baffle 32 is disposed, or upstream or downstream of the baffle 32 in the light exit direction 30, so that the fractional beams 28 can pass through the light admission opening 34. The beam 20 reflected by the central reflector region 16, because of its at least approximately parallel orientation to the optical axis 11, can also pass through the light admission opening 34 of the baffle 32. The beams 28 reflected by the peripheral reflector regions 24 in the beam 20 reflected by the central reflector region 16 are superimposed on one another and together form the beam of light that emerges from the headlight.

Downstream of the baffle 32 in the light exit direction 30, a transparent disk 38 may be disposed, which can form a cover disk of the headlight. The cover disk 38 can be of glass or plastic and can be embodied as essentially smooth, so that the fractional beams 20 and 28 reflected by the reflector 10 pass through it essentially unchanged.

Alternatively, the cover disk 38 can also have optically active profiles, by means of which the fractional beams 20 and 28 reflected by the reflector 10 are influenced as they pass through the cover disk 38, or in other words deflected in certain directions and/or scattered. Thus during headlight operation, what emerges from the headlight is a beam of light with pronounced horizontal scattering and with less vertical scattering, which is what is needed to improve viewing conditions for the vehicle driver in fog, heavy rain, or snow. The beam has a relatively short range, but it provides adequate illumination especially of the edges of the roadway in front of the vehicle, thus helping the driver to be better oriented.

On its front side pointing in the light exit direction 30, the baffle 32 may for instance be provided with a reflective coating 40, or it may be painted in the color of the vehicle body or some color adapted to it. This can improve the appearance of the headlight. The baffle 32 may also, in a departure from the version described above and shown in FIG. 1, be disposed downstream of the cover disk 38 in the light exit direction 30. Then the baffle 32 can be formed for instance by a body part or bumper of the vehicle that is provided with the light admission opening 34.

What is claimed is:

1. A headlight for vehicles, having a light source (12) and a reflector (10), which is embodied at least regionally in such a way that through it, light emitted by the light source (12) is reflected as a beam (20, 28) of light that converges in horizontal longitudinal planes (22) and is at least approximately parallel in vertical longitudinal planes (18), in the light exit direction (30) downstream of the reflector (10), an opaque baffle (32) is disposed, which has a light admission opening (34) whose cross section is smaller than the cross section of the reflector (10) on the front edge (36) thereof pointing in the light admission opening (30), and that the beam (20, 28) reflected by the reflector (10) is concentrated at least substantially on the light admission opening (34) of the baffle (32) and the light admission opening (34) of the baffle (32) is embodied as at least approximately circular or oval in cross section.

2. The headlight of claim 1, wherein the reflector (10) is embodied in such a way that by means of at least one central reflector region (16), light emitted by the light source (12) is reflected as a fractional beam (20) that is at least approximately parallel in the horizontal longitudinal planes (22), and that by means of at least one peripheral reflector region (24), light emitted by the light source (12) is reflected as a fractional beam (28) converging in horizontal longitudinal planes (22).

3. The headlight of claim 2, wherein the at least one peripheral reflector region (24) is embodied in such a way that by it, light emitted by the light source (12) is reflected as a fractional beam (28) which converges increasingly more markedly in horizontal longitudinal planes (22) as the distance from the optical axis (11) increases.

4. The headlight of claim 1 wherein the beam (20, 28) reflected by the reflector (10) has an upper light/dark boundary that has an at least approximately horizontal course.

* * * * *